US009887036B2

(12) United States Patent
Kawashima

(10) Patent No.: US 9,887,036 B2
(45) Date of Patent: Feb. 6, 2018

(54) COIL END CONNECTING STRUCTURE

(71) Applicant: SUMIDA CORPORATION, Chuo-Ku, Tokyo (JP)

(72) Inventor: Takao Kawashima, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 0 days.

(21) Appl. No.: 15/076,909

(22) Filed: Mar. 22, 2016

(65) Prior Publication Data

US 2016/0293323 A1 Oct. 6, 2016

(30) Foreign Application Priority Data

Apr. 6, 2015 (JP) ..... 2015-077702

(51) Int. Cl.

| | |
|---|---|
| ***H01R 4/10*** | (2006.01) |
| ***H01F 27/28*** | (2006.01) |
| ***H01F 5/04*** | (2006.01) |
| ***H01R 4/18*** | (2006.01) |
| ***H01R 4/20*** | (2006.01) |

(52) U.S. Cl.

CPC ..... *H01F 27/2828* (2013.01); *H01F 5/04* (2013.01); *H01F 27/2852* (2013.01); *H01R 4/182* (2013.01); *H01R 4/20* (2013.01)

(58) Field of Classification Search

CPC ..... H01F 27/2828; H01F 27/2852; H01F 27/2847; H01F 5/04; H01R 4/20; H01R 4/182; H01R 4/18; H01R 4/184

USPC ..... 439/607.51, 587, 879, 877, 880, 887, 439/878, 585

See application file for complete search history.

(56) References Cited

U.S. PATENT DOCUMENTS 3,278,889 A * 10/1966 Elliott ..... H01R 4/183 439/868
4,531,807 A * 7/1985 Trigon ..... H01R 13/5213 439/866
4,833,437 A 5/1989 Williamson (Continued)

FOREIGN PATENT DOCUMENTS

CN 2899056 Y 5/2007
CN 202034188 U 11/2011
CN 202076092 U 12/2011

(Continued)

OTHER PUBLICATIONS

Extended European Search Report corresponding to Application No. 16020086.1-1556; dated Aug. 10, 2016.

(Continued)

*Primary Examiner* — Mangtin Lian
(74) *Attorney, Agent, or Firm* — Cantor Colburn LLP

(57) ABSTRACT

A coil end connecting structure for connecting a coil end part extending from a coil winding part formed by winding a flat wire, includes: a narrow-width part which is formed by forming a cut part made by cutting out the coil end part on a tip side at least on one side in a width direction thereof; an end connecting member which includes a cylinder body part in a cylindrical shape and in which the narrow-width part is inserted in an inner cylinder part of the cylinder body part; and a crimp part which crimps the cylinder body part to electrically connect the narrow-width part and the end connecting member.

6 Claims, 5 Drawing Sheets

(56) References Cited

U.S. PATENT DOCUMENTS

2016/0056678 A1* 2/2016 Ogawa ..... H01R 4/184
310/71

FOREIGN PATENT DOCUMENTS

| | | | |
|---|---|---|---|
| DE | 2653549 | A1 | 6/1978 |
| JP | 2001167940 | A | 6/2001 |
| JP | 2004319157 | A | 11/2004 |
| JP | 2010282914 | A | 12/2010 |
| WO | 2014156019 | A1 | 10/2014 |
| WO | WO 2015/104911 | A1 * | 6/2015 |

OTHER PUBLICATIONS

State Intellectual Property Office of People's Republic of China Notification of the First Office Action corresponding to Application No. 201610161668.3; dated May 16, 2017.

* cited by examiner

COIL END CONNECTING STRUCTURE

CROSS REFERENCE TO RELATED APPLICATION

This application is based upon and claims the benefit of priority from Japanese patent application No. 2015-077702, filed on Apr. 6, 2015, the disclosure of which is incorporated herein in its entirety by reference.

TECHNICAL FIELD

The present invention relates to a coil end connecting structure.

BACKGROUND ART

It is widely performed to form a coil winding using a flat wire. An end of the coil winding is electrically connected to a cable for connecting to another electric instrument via a tubular end connecting member called a sleeve (crimp contact). As a technique of connecting the end connecting member and the end of the flat wire, there is a technical content as disclosed, for example, in Patent Document 1 (Japanese Patent Application Laid-Open No. 2004-319157). In Patent Document 1, the end of the flat wire is deformed into a V-shape and the end in the V-shape is inserted into an inner cylinder part of the sleeve. After the insertion, pressure is applied on the sleeve to crash the sleeve to thereby electrically and mechanically connect the end of the flat wire and the sleeve.

SUMMARY OF INVENTION

Technical Problem

Incidentally, in the case of deforming the end into the V-shape and inserting the end into the inner cylinder part as in Patent Document 1, there is a problem as follows. More specifically, the size of the sleeve is determined depending on required current. At this time, the required size of the sleeve is determined from the dimension of the cable for connecting to another electric instrument. At this time, it is generally advantageous to use a sleeve having a small diameter from among selectable sleeves in terms of costs and space saving and so on. However, there is a limit in bending the end of the flat wire into the V-shape in accordance with the sleeve having the small diameter, and therefore it is inevitable to use a sleeve larger in diameter than the sleeve required in terms of current in order to accommodate the end in the V-shape in the inner cylinder part.

On the other hand, the tensile strength of a joint portion is specified by JIS C2085 regarding a sleeve having each size, and the cross-sectional area satisfying the tensile strength is indicated from a crimp contact manufacturer. However, as the diameter of the sleeve increases, the cross-sectional area of a conductor portion required for the inner cylinder part also increases. For this reason, the required cross-sectional area of the conductor portion cannot be satisfied only by folding the end into the V-shape, and at present, another additional conductor portion is sometimes inserted into the inner cylinder part to secure the cross-sectional area. In this case, the need of the other conductor portion accordingly requires not only cost and but also man-hour.

The present invention has been made in consideration of the problem, and its object is to provide a coil end connecting structure capable of realizing necessary and sufficient connection without increasing the size of an end connecting member for connecting an end of a flat wire.

Solution to Problem

To solve the above problem, the present invention is a coil end connecting structure for connecting a coil end extending from a coil winding part formed by winding a flat wire, the coil end connecting structure including: a narrow-width part which is formed by forming a cut part made by cutting out the coil end part on a tip side at least on one side in a width direction thereof; an end connecting member which includes a cylinder body part in a cylindrical shape and in which the narrow-width part is inserted in an inner cylinder part of the cylinder body part; and a crimp part which crimps the cylinder body part to electrically connect the narrow-width part and the end connecting member.

Further, in another aspect of the coil end connecting structure of the present invention, it is preferable, in addition to the above invention, that the cut parts are provided on both sides in the width direction of the narrow-width part.

Furthermore, in another aspect of the coil end connecting structure of the present invention, it is preferable, in addition to the above invention, that an inner projecting part projecting to an inside of the inner cylinder part is formed at a middle portion in a longitudinal direction of the end connecting member, by denting an outer peripheral surface of the cylinder body part toward the inner cylinder part side, and that the narrow-width part is provided to have a length equal to or smaller than a length of the inner projecting part, and a stepped part of the narrow-width part comes into contact with an end surface of the end connecting member.

Furthermore, in another aspect of the coil end connecting structure of the present invention, it is preferable, in addition to the above invention, that between the stepped part and a side surface of the narrow-width part, a curved surface part is provided which smoothly connects the stepped part and the side surface of the narrow-width part.

Furthermore, in another aspect of the coil end connecting structure of the present invention, it is preferable, in addition to the above invention, that the narrow-width part is provided with a folded part, and the folded part is folded back toward a root side of the narrow-width part.

Advantageous Effects of Invention

According to the present invention, a coil end connecting structure becomes capable of realizing necessary and sufficient connection without increasing the size of an end connecting member for connecting an end of a flat wire.

DESCRIPTION OF EMBODIMENTS

Hereinafter, a connecting structure 11 of a coil winding 10 according to one embodiment of the present invention will be described based on the drawings.

<Regarding a Winding Structure Having a Coil End Connecting Structure>

Figure 1:
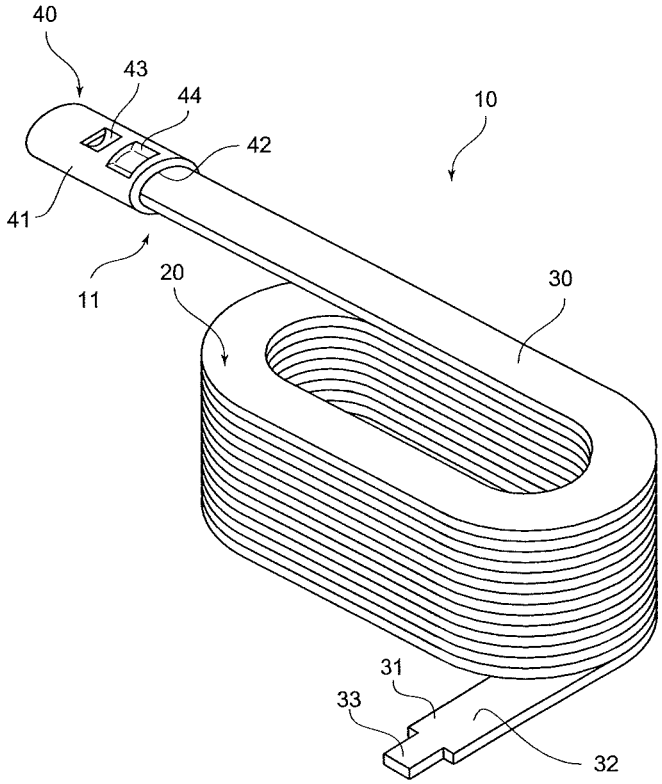
FIG. 1 is a perspective view illustrating the entire winding structure having a coil end connecting structure according to one embodiment of the present invention.

FIG. 1 is a perspective view illustrating the whole of a winding structure 10 having the coil end connecting structure 11. As illustrated in FIG. 1, the winding structure 10 in this embodiment includes, as main components, a coil winding part 20 and a sleeve 40.

Further, the coil end connecting structure 11 has an end portion extending part 32 extending from the coil winding part 20, and the sleeve 40 attached to the end portion extending part 32. Hereinafter, those components will be sequentially described.

The coil winding part 20 is formed by winding a flat wire 30. The flat wire 30 is a conducting wire having a rectangular cross section, and its surface is covered by an insulating coating such as enamel or the like. In FIG. 1, the shape of the coil winding part 20 in a plan view is a rounded corner rectangle. However, as the shape of the coil winding part 20, various shapes such as a circular shape, elliptical shape, rectangular shape and so on in a plan view are employable.

Here, as illustrated in FIG. 1, from the coil winding part 20, a coil end part 32 made by extending a part of the flat wire 30 exists. In other words, the coil end part 32 is a portion of the flat wire 30 which does not form the coil winding part 20.

Figure 2:
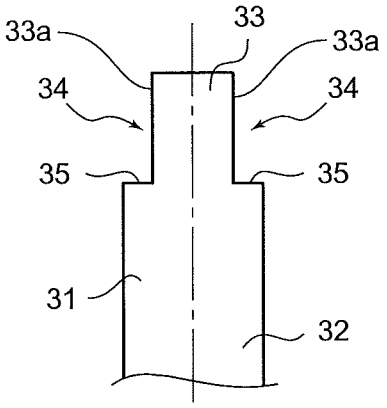
FIG. 2 is an enlarged plan view illustrating a tip side of a coil end part in the coil end connecting structure in FIG. 1.

FIG. 2 is an enlarged plan view illustrating a tip side of the coil end part 32. As illustrated in FIG. 2, on the tip side of the coil end part 32, a narrow-width part 33 is provided. The narrow-width part 33 is formed by providing cut parts 34 made by cutting out the coil end part 32 on both sides in the width direction. More specifically, the narrow-width part 33 is provided such that it is smaller in width dimension than the other portion of the flat wire 30 by an amount corresponding to the existence of the cut parts 34 that are portions made by punching the coil end part 32.

In crimp joining, when the narrow-width part 33 is stuck into the later-described sleeve 40 and a later-described crimp part 44 is further formed, the narrow-width part 33 and the sleeve 40 need to come into mechanical contact with each other without the insulating coating intervening therebetween, and thereby secure electrical conduction between them. Two surfaces of the narrow-width part 33 other than the cut parts 34 are peeled off in advance or after performing the present invention, but provision of the cut parts 34 makes it possible to eliminate the need for the peeling process of the above two surfaces.

Note that a portion of the flat wire 30 having a width dimension other than that of the narrow-width part 33 is sometimes called a main wire part 31.

Here, since the existence of the cut parts 34 at the coil end part 32, stepped parts 35 are provided at the coil end part 32. The stepped parts 35 are end surface portions of the main wire part 31 facing the cut parts 34. The stepped parts 35 are configured such that an opening end portion of the sleeve 40 can come into contact therewith. However, when the narrow-width part 33 is long in length, the opening end portion of the sleeve 40 does not, any longer, come into contact with the stepped parts 35.

Figure 3:
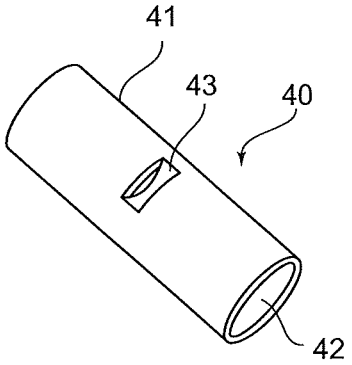
FIG. 3 is a perspective view illustrating the configuration of a sleeve in the coil end connecting structure in FIG. 1.
Figure 4:
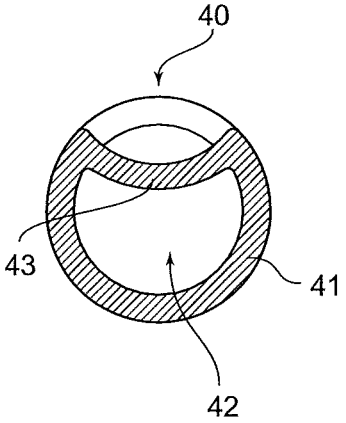
FIG. 4 is a front cross-sectional view illustrating a state that the sleeve in the coil end connecting structure in FIG. 1 is cut at a middle in its longitudinal direction.

FIG. 3 is a perspective view illustrating the configuration of the sleeve 40. FIG. 4 is a front cross-sectional view illustrating the state that the sleeve 40 is cut at the middle in its longitudinal direction. As illustrated in FIG. 3 and FIG. 4, the sleeve 40 made of metal includes a cylinder body part 41 in a cylindrical shape, and the cylinder body part 41 is provided with an inner cylinder part 42 in a pore shape. Note that the sleeve 40 corresponds to an end connecting member.

At a middle portion in the longitudinal direction of the sleeve 40, an inner projecting part 43 is provided which is made by denting an outer peripheral surface of the cylinder body part 41 toward the inner cylinder part 42 side. The inner projecting part 43 is provided to project to the inside of the inner cylinder part 42. Therefore, when the narrow-width part 33 is stuck into the inner cylinder part 42 from its opening on one end side and the length of the narrow-width part 33 is longer than the length from the opening on the one end side of the inner cylinder part 42 to the inner projecting part 43, the inner projecting part 43 prevents the narrow-width part 33 from being further stuck thereinto.

Further, in this embodiment, on the outer peripheral surface of the cylinder body part 41, the crimp part 44 as illustrated in FIG. 1 is provided. The crimp part 44 is a portion for electrically connecting the narrow-width part 33 and the sleeve 40, and when the narrow-width part 33 is stuck into the inner cylinder part 42 of the cylinder body part 41 and, in this state, a predetermined region of the cylinder body part 41 closer to the opening on the one end side than the inner projecting part 43 is deformed to be crashed, side surfaces 33*a* of the narrow-width part 33 and the sleeve 40 come into mechanical contact with each other. This makes a state that the electrical conduction is secured between the sleeve 40 and the narrow-width part 33.

Note that from an opening on the other end side of the inner cylinder part 42, a cable to be connected to a not-illustrated electric instrument is stuck. Besides, the electrical connection to an external electric instrument using a crimp contact may be enabled by sticking the crimp contact into the opening on the other end side of the inner cylinder part 42.

<Regarding a Method of Manufacturing the Coil End Connecting Structure>

In the case of forming the above coil end connecting structure 11, the coil end part 32 of the flat wire 30 is punched on the tip side to form the cut parts 34. This forms the narrow-width part 33. Then, the narrow-width part 33 is inserted into the inner cylinder part 42, and thereafter, the outer peripheral surface of the sleeve 40 in which the narrow-width part 33 is inserted is crashed to form the crimp part 44. Thus, the coil end connecting structure 11 as illustrated in FIG. 1 is formed.

<Regarding the Dimensional Relationship Between the Sleeve and Narrow-Width Part>

In the above-described sleeve 40, the cross-sectional area of a conductor to be stuck into the inner cylinder part 42 is specified by JIS and the like according to its diameter. For example, it is specified that for a sleeve 40 having a large diameter, a conductor to be stuck into the inner cylinder part 42 needs to have a large cross-sectional area, whereas, conversely, for a sleeve 40 having a small diameter, a conductor to be stuck into the inner cylinder part 42 may have a small cross-sectional area. Under such a limit, it is advantageous in terms of costs and space saving to use a sleeve 40 having a diameter as small as possible as far as the specification of a working current is satisfied to make do with the small cross-sectional area of the conductor.

Incidentally, in a conventional configuration, a coil end part is deformed into a V-shape as disclosed in Patent Document 1 and the deformed coil end part is inserted into an inner cylinder part. In this case, there is a limit to deform a flat wire into the V-shape. Therefore, a sleeve larger in diameter than a sleeve having a diameter calculated from the requirements of the working current is to be used. However, with such a sleeve having a larger diameter, the cross-sectional area required by the sleeve having the diameter is not satisfied, and therefore it is necessary to additionally insert another connecting member into the inner cylinder part.

The case of bending the coil end part into the V-shape and inserting it into the inner cylinder part of the sleeve as in the conventional configuration, requires labor and costs in bending the coil end part into the V-shape and sticking the other connecting member into the inner cylinder part.

In contrast, this embodiment employs a configuration that the narrow-width part 33 having a small width dimension is stuck into the inner cylinder part 42 of the sleeve 40. The case of sticking the narrow-width part 33 into the inner cylinder part 42 as described above only requires a sleeve 40 having a diameter small by an amount corresponding to the small width dimension of the narrow-width part 33.

Here, the case of bending the coil end part into the V-shape and the case of providing the cut parts 34 on the tip side of the coil end part 32 to form the narrow-width part 33 are compared with each other. Then, for example, in the case of forming the narrow-width part 33, it is easy to double the aspect ratio by halving the width dimension of the narrow-width part 33 or the like (namely, it is easy to double the ratio of the cross-sectional area of the conductor in the cross-sectional area of the inner cylinder part 42). However, in the case of bending into the V-shape, it is not easy to rapidly increase the ratio of the cross-sectional area of the conductor in the cross-sectional area of the inner cylinder part 42.

In contrast to the above, in this embodiment, the diameter of the sleeve 40 decreases, whereas the aspect ratio of the narrow-width part 33 increases, so that the ratio of the narrow-width part 33 being a conductor portion in the cross-sectional area of the inner cylinder part 42 rapidly increases. This eliminates the need to insert, into the inner cylinder part 42, the additional connecting member which may be necessary when embodying the configuration of Patent Document 1.

Figure 5:
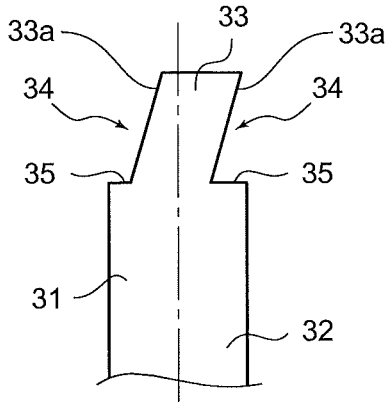
FIG. 5 relates to a modification example of this embodiment and is a plan view illustrating a configuration in which a narrow-width part is provided so that its axial direction is diagonal with respect to an axial direction of a flat wire.
Figure 6:
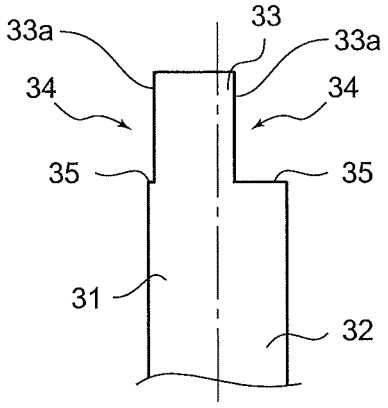
FIG. 6 relates to a modification example of this embodiment and is a plan view illustrating a configuration in which the narrow-width part deviates toward any one side in the width direction.

Note that the narrow-width part 33 is not limited to the configuration illustrated in FIG. 2. For example, the narrow-width part 33 may be provided so that its axial direction is diagonal to the axial direction of the flat wire 30 as illustrated in FIG. 5. Further, the narrow-width part 33 may deviate toward any one side in the width direction as illustrated in FIG. 6, and a configuration in which the cut part 34 does not exist on one side in the width direction may be employed.

Figure 7:
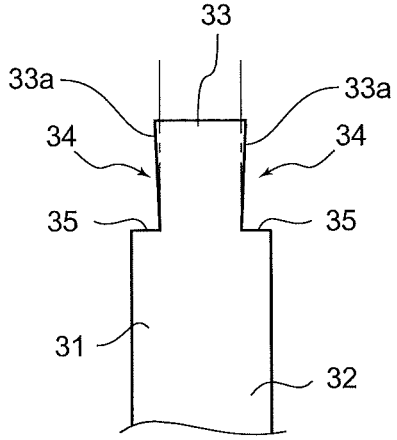
FIG. 7 relates to a modification example of this embodiment and is a plan view illustrating a configuration in which the narrow-width part is slightly wider on its tip side than on its root side.

Further, the narrow-width part 33 may be provided such that it is slightly wider on its tip side than on its root side as illustrated in FIG. 7. In this case, the narrow-width part 33 on the tip side can be made to function as a pulling-out preventer when it is stuck into the inner cylinder part 42.

Figure 8:
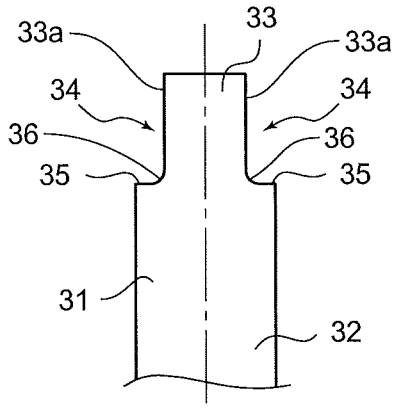
FIG. 8 relates to a modification example of this embodiment and is a plan view illustrating a configuration in which curved surface parts are provided between stepped parts and side surfaces of the narrow-width part.

Further, a configuration in which curved surface parts 36 smoothly connecting the stepped parts 35 and the side surfaces 33*a* of the narrow-width part 33 are provided between them as illustrated in FIG. 8 can also be employed. In the case of providing the curved surface parts 36, it becomes possible to prevent places where stress concentrates from being formed between the stepped parts 35 and the narrow-width parts 33.

Incidentally, the formation of the cut parts 34 on the tip side of the coil end part 32 may lead to the cross-sectional area of the narrow-width part 33 still insufficient to the diameter of the sleeve 40 in the case where the narrow-width part 33 is formed. In this case, once the cut parts 34 are formed to form the narrow-width part 33, the aspect ratio increases. Therefore, it becomes difficult to perform processing by bending the coil end part 32 into the V-shape to introduce it into the inner cylinder part 42 or the like.

In this case, the problem of the insufficient cross-sectional area can be solved as follows.

Figure 9:
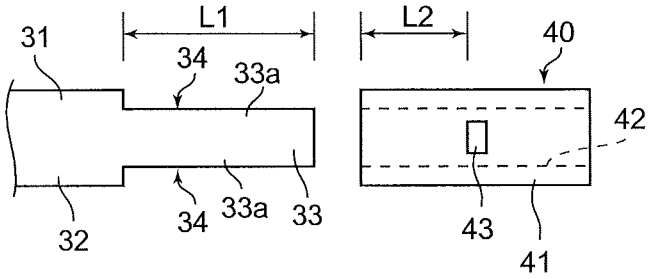
FIG. 9 relates to a modification example of this embodiment and is a plan view for explaining a solving technique when a cross-sectional area of the narrow-width part is insufficient, and is a plan view illustrating a state before a folded part is formed at the narrow-width part.
Figure 10:
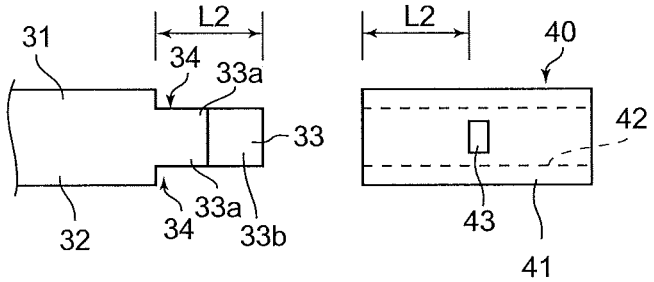
FIG. 10 relates to a modification example of this embodiment and is a plan view illustrating a state after the folded part is formed at the narrow-width part from the state in FIG. 9.
Figure 11:
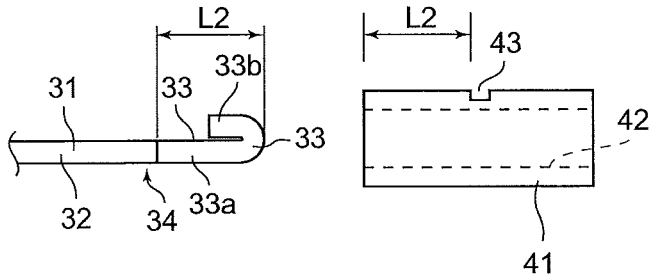
FIG. 11 is a side view of the configuration in FIG. 10.

FIG. 9 is a plan view for explaining a solving technique when the cross-sectional area of the narrow-width part 33 is insufficient, and is a plan view illustrating a state before a folded part 33*b* is formed at the narrow-width part 33. Further, FIG. 10 is a plan view illustrating a state after the folded part 33*b* is formed at the narrow-width part 33 from the state in FIG. 9. FIG. 11 is a side view of the configuration of FIG. 10. As illustrated in FIG. 9, a length L1 of the narrow-width part 33 is provided to be sufficiently longer than a length L2 from the opening end portion to the inner projecting part 43 in the inner cylinder part 42.

With respect to the narrow-width part 33 having the length L1 being the sufficient length, the narrow-width part 33 on the tip side is folded back toward the main wire part 31 to form the folded part 33*b* as illustrated in FIG. 10 and FIG. 11. In other words, on the tip side of the narrow-width part 33, the folded part 33*b* is provided. In this event, in the narrow-width part 33, the length from its root to a curved region of the folded part 33*b* being the tip portion in the longitudinal direction is longer than the above-described length L2, and the cross-sectional area is secured over the entire length of the inserted part.

The folded part 33*b* is inserted into the inner cylinder part 42 in addition to the narrow-width part 33 as described above, whereby the conductor to be stuck into the inner cylinder part 42 is the narrow-width part 33 and the folded part 33*b*. This makes it possible to increase the cross-sectional area of the conductor to be stuck into the inner cylinder part 42, and thereby provide the same effect as that in the case of inserting the additional connecting member in Patent Document 1.

<Regarding Effect>

According to the coil end connecting structure 11 in the above configuration, the flat wire 30 is cut out at least on one side in its width direction to form the cut part 34 to thereby form the narrow-width part 33. Then, the narrow-width part 33 is inserted into the inner cylinder part 42 of the sleeve 40, and thereafter the outer peripheral surface of the sleeve 40 is crashed to form the crimp part 44. Thus, since the narrow-width part 33 small in width dimension is inserted into the inner cylinder part 42, the diameter of the sleeve 40 can be small.

Further, while the diameter of the sleeve 40 decreases, the aspect ratio of the narrow-width part 33 increases. Therefore, the ratio of the narrow-width part 33 being a conductor portion in the cross-sectional area of the inner cylinder part 42 increases. This eliminates the need to insert, into the inner cylinder part 42, the additional connecting member which may be necessary in Patent Document 1.

Further, it is unnecessary to deform the coil end part 32 into the V-shape and it becomes unnecessary to insert the additional connecting member into the inner cylinder part 42, unlike the conventional configuration. Therefore, the labor such as bending the coil end part into the V-shape and sticking the additional connecting member into the inner cylinder part can be omitted to reduce the man-hour.

Further, the cut parts 34 are provided on both sides in the width direction of the narrow-width part 33 in this embodiment. This can prevent the sleeve 40 from deviating toward any one side in the width direction with respect to the flat wire 30 when the narrow-width part 33 is inserted into the inner cylinder part 42 of the sleeve 40.

Further, in this embodiment, the inner projecting part 43 projecting to the inside of the inner cylinder part 42 is formed at the middle portion in the longitudinal direction of the sleeve 40, by denting the outer peripheral surface of the cylinder body part 41 toward the inner cylinder part 42 side. Further, the narrow-width part 33 is provided to have a length equal to or smaller than that of the inner projecting part 43, and the stepped parts 35 of the narrow-width part 33 come into contact with the end surface of the sleeve 40. Therefore, by bringing the stepped parts 35 into contact with the end surface of the sleeve 40, the narrow-width part 33 can be accurately positioned with respect to the sleeve 40.

Further, between the stepped parts 35 and the side surfaces 33*a* of the narrow-width part 33, the curved surface parts 36 smoothly connecting them are provided in this embodiment. Therefore, it is possible to prevent places where stress concentrates from being formed between the stepped parts 35 and the narrow-width parts 33.

Further, the folded part 33*b* is provided at the narrow-width part 33, and the folded part 33*b* is folded back toward the root side of the narrow-width part 33 in this embodiment. Therefore, even when the cross-sectional area of only the narrow-width part 33 is insufficient with respect to the sleeve 40, a sufficient cross-sectional area with respect to the sleeve 40 can be secured by inserting also the folded part 33*b* into the inner cylinder part 42. In other words, the cross-sectional area of the conductor portion can be increased to be double with respect to the inner diameter of the inner cylinder part 42, thereby making it possible to rapidly increase the required cross-sectional area of the conductor portion.

Modification Example

One embodiment of the present invention has been described above, and the present invention is variously modified other than the above. Hereinafter, they will be described.

In the above-described embodiment, a not-illustrated cable of electric instrument to be stuck into the inner cylinder part 42 from its opening on the other end side is not included as the coil end connecting structure 11. However, the cable may be included in the concept of the coil end connecting structure 11.

Further, regarding the end connecting member, the case where a sleeve in an entirely cylindrical shape is used is described in the above-described embodiment. However, the end connecting member is not limited to the sleeve in an entirely cylindrical shape. For example, a crimp contact may be used as the end connecting member.

Further, the winding structure 10 is not particularly referred to in this embodiment. However, the winding structure 10 may constitute, for example, a reactor, and may be constitute a transformer or the like.

The invention claimed is:

1. A coil end connecting structure for connecting a coil end extending from a coil winding part formed by winding a flat wire, the coil end connecting structure comprising:

a narrow-width part which is formed by forming a cut part made by cutting out a conductive part of the coil end part, not an enamel film part of the coil end part, on a tip side at least on one side in a width direction thereof;

an end connecting member which includes a cylinder body part in a cylindrical shape and in which the narrow-width part is inserted in an inner cylinder part of the cylinder body part; and a crimp part which is provided in the cylinder body part and crimped so as to electrically connect the narrow-width part and the end connecting member, the crimp part having a circular circumference before crimping;

wherein an inner projecting part projecting to an inside of the inner cylinder part is formed at a middle portion in a longitudinal direction of the end connecting member, by denting an outer peripheral surface of the cylinder body part toward the inner cylinder part side, the inner projecting part being orthogonal to an axial direction of the end connecting member, and wherein the narrow-width part is provided to have a length equal to or smaller than a length of the inner projecting part, and a stepped part of the narrow-width part comes into contact with an end surface of the end connecting member, and the inner projecting part prevents the narrow-width part from being further stuck into the inner cylinder part.

2. The coil end connecting structure according to claim 1, wherein the cut parts are provided on both sides in the width direction of the narrow-width part.

3. The coil end connecting structure according to claim 1, wherein between the stepped part and a side surface of the narrow-width part, a curved surface part is provided which smoothly connects the stepped part and the side surface of the narrow-width part.

4. The coil end connecting structure according to claim 1, wherein the narrow-width part is provided with a folded part, and the folded part is folded back toward a root side of the narrow-width part.

5. The coil end connecting structure according to claim 2, wherein the narrow-width part is provided with a folded part, and the folded part is folded back toward a root side of the narrow-width part.

6. The coil end connecting structure according to claim 3, wherein the narrow-width part is provided with a folded part, and the folded part is folded back toward a root side of the narrow-width part.

* * * * *